US009214326B2

(12) United States Patent
Döring et al.

(10) Patent No.: US 9,214,326 B2
(45) Date of Patent: Dec. 15, 2015

(54) ATMOSPHERIC PRESSURE CHEMICAL IONIZATION ION SOURCE

(75) Inventors: Hans-Rüdiger Döring, Leipzig (DE); Klaus Zimmer, Parthenstein (DE); Joachim Zajadacz, Leipzig (DE)

(73) Assignee: Bruker Daltonik GmbH, Bremen (DE)

( * ) Notice: Subject to any disclaimer, the term of this patent is extended or adjusted under 35 U.S.C. 154(b) by 1065 days.

(21) Appl. No.: 12/252,050

(22) Filed: Oct. 15, 2008

(65) Prior Publication Data

US 2009/0095917 A1 Apr. 16, 2009

(30) Foreign Application Priority Data

Oct. 15, 2007 (DE) ..... 10 2007 049 350

(51) Int. Cl.
*H01J 49/26* (2006.01)
*H01J 49/14* (2006.01)

(52) U.S. Cl.
CPC ..... *H01J 49/145* (2013.01)

(58) Field of Classification Search
USPC ..... 250/427, 423 R, 424, 281, 282, 288, 250/492.1, 492.3, 290, 291, 292, 293, 294, 250/295, 296, 297; 315/111.01, 111.1, 315/111.81; 313/420, 317
See application file for complete search history.

(56) References Cited

U.S. PATENT DOCUMENTS

| | | | | |
|---|---|---|---|---|
| 2,010,702 | A | 8/1935 | Coolidge | |
| 4,862,490 | A | 8/1989 | Karnezos et al. | |
| 5,969,349 | A | 10/1999 | Budovich et al. | |
| 6,023,169 | A | 2/2000 | Budovich et al. | |
| 6,140,755 | A * | 10/2000 | Neukermans et al. | 313/420 |
| 6,586,729 | B2 * | 7/2003 | Doring | 250/287 |
| 6,803,570 | B1 * | 10/2004 | Bryson et al. | 250/305 |
| 6,806,466 | B2 | 10/2004 | Guevremont et al. | |
| 7,005,632 | B2 | 2/2006 | Miller et al. | |
| 7,105,808 | B2 * | 9/2006 | Bromberg et al. | 250/287 |
| 7,385,210 | B2 | 6/2008 | Ulrich et al. | |
| 2002/0179832 | A1 * | 12/2002 | Fischer et al. | 250/288 |
| 2006/0054879 | A1 * | 3/2006 | Jin | 257/10 |
| 2006/0144778 | A1 | 7/2006 | Grunthaner et al. | |

FOREIGN PATENT DOCUMENTS

| | | | |
|---|---|---|---|
| WO | WO 94/16320 | 7/1994 | |
| WO | 9952124 | 10/1999 | |
| WO | WO 2004/097882 | 11/2004 | |
| WO | WO 2007/008216 | 1/2007 | 5/18 |

OTHER PUBLICATIONS

Ulrich et al. "Excitation of Dense Gases with Low-Energy Electron Beans", Physikalische Blatter, 56 (2000), No. 6, pp. 49-52.
Haase et al. "Electron Permeable Membranes for MEMS Electron Sources", Sensors and Actuators A: Physical, vol. 132 (2006), No. 1, pp. 98-103.

* cited by examiner

*Primary Examiner* — Nicole Ippolito
(74) *Attorney, Agent, or Firm* — O'Shea Getz P.C.

(57) ABSTRACT

An ion source for chemical ionization of analytes at atmospheric pressure with a non-radioactive electron source in a vacuum chamber, includes, a reaction chamber at atmospheric pressure, and a window with an electron-permeable and essentially gas-impermeable membrane in between. The window may be a structured window membrane, i.e. a window membrane with a structured form comprising a multitude of structural elements, between the reaction chamber and the vacuum chamber.

22 Claims, 5 Drawing Sheets

ATMOSPHERIC PRESSURE CHEMICAL IONIZATION ION SOURCE

PRIORITY INFORMATION

This patent application claims priority from German patent application 10 2007 049 350.0 filed Oct. 15, 2007, which is hereby incorporated by reference.

FIELD OF THE INVENTION

The present invention relates to an ion source for chemical ionization of analytes at atmospheric pressure with a non-radioactive electron source in a vacuum chamber, a reaction chamber at atmospheric pressure and a window with an electron-permeable and essentially gas-impermeable membrane in between.

BACKGROUND OF THE INVENTION

Chemical ionization at atmospheric pressure (APCI=Atmospheric Pressure Chemical Ionization) is a known method for creating analyte ions in ion mobility spectrometers (IMS) and mass spectrometers. In this context, atmospheric pressure refers to a pressure of between $6\times10^4$ and $1.2\times10^5$ Pascal.

In chemical ionization, the molecules of a gas containing analyte molecules, referred to below as the carrier gas, are first ionized by interaction with nuclear radiation ($\alpha$, $\beta$, or $\gamma$ radiation), or with electrons, X-ray quanta, UV light or in combination. In a cascade of primary reactions, the so-called reactant ions are created. The analyte molecules are ionized by secondary reactions with the reactant ions. These secondary reactions include the transfer of electrons, protons and other charged species from the reactant ions to the analyte molecules. Negative or positive analyte ions are created, depending on the properties of analyte and reactant molecules.

APCI ion sources are employed in mass spectrometry, in particular in combination with chromatographic separation processes such as gas chromatography (GC/MS) and liquid chromatography (LC/MS).

IMS devices with drift gas at atmospheric pressure are primarily employed for the detection of trace organic vapors from drugs, pollutants, warfare agents and explosives in the air and on surfaces. Apart from the most commonly used time-of-drift type (see FIG. 3), there are other less widely employed ion mobility spectrometers, such as the "Differential Mobility Spectrometer" (disclosed by Miller et al. in U.S. Pat. No. 7,005,632 B2), the "Field Asymmetric Waveform IMS" (disclosed by Guevremont et al. in U.S. Pat. No. 6,806,466 B2) or the "Aspiration Type IMS" from the Finnish company Environics Oy (disclosed in patent publication WO 94/16320 A1).

In almost all atmospheric pressure IMS systems used commercially, the analyte ions are generated by radioactive APCI ion sources; beta emitters such as tritium ($^3$H) and, in particular, $^{63}$Ni are used, and also the alpha emitter $^{241}$Am. The mean kinetic energy of the electrons from beta emitters is between about 5 and 16 keV. Due to the restrictions that surround the use of radioactive sources, non-radioactive ionization methods have also been investigated since work began on IMS. This work has concentrated on photoionization and on corona discharge. Experience has shown that both methods involve different ionization processes from those of a $^{63}$Ni source, leading to different types of analyte ions: see, Dzidic et al.: "Comparison of Positive Ions Formed in Nickel-63 and Corona Discharge Ion Sources Using Nitrogen, Argon, Isobutene, Ammonia and Nitric Oxide as Reagents in Atmospheric Pressure Ionization-MS", in: Anal. Chem., 1976, Vol. 48, No. (12), pages 1763-1768. Some analyte molecules cannot be ionized at all by these methods, which therefore do not represent equally effective alternatives to the radioactive electron sources $^{63}$Ni, $^3$H and the alpha emitter $^{241}$Am.

The patent specifications DE 196 27 620 C1 and DE 196 27 621 C2 from Budovich et al. disclose non-radioactive APCI ion sources in which electrons are generated in a vacuum chamber using a non-radioactive electron source and reach an electron capture detector (ECD) or the reaction region of an IMS by passing through a window that is permeable to electrons but impermeable to gas. The primary and secondary reactions of the chemical ionization take place in the ECD chamber or in the reaction chamber of the IMS after the electrons have entered through the window. In one embodiment, the window has a plane disk of mica between three and five micrometers thick which, having a diameter of five millimeters, is able to withstand a pressure difference of one atmosphere. It has, however, been found that the ion currents in IMS are significantly smaller than when a commercial $^{63}$Ni source with an activity of 100 MBq, corresponding to the currently permitted limit, is used. The result is a worse signal-to-noise ratio and a markedly poorer detection limit for analytes. The reason for this is that the mica disk is not sufficiently permeable to electrons with an energy of around 15 keV.

Electron sources with windows that are impermeable to gas but permeable to electrons are known from other applications, such as Ulrich et al. ("Anregung dichter Gase mit niederenergetischen Elektronenstrahlen" ("Excitation of Dense Gases with Low-Energy Electron Beams"), in: Physikalische Blätter, 56 (2000), No. 6, pages 49-52), and show that windows with a plane membrane of silicon nitride, having a thickness of only 200 to 300 nanometers, can be produced. A window of this type can withstand a pressure difference of one atmosphere if the surface area of the thin silicon nitride membrane does not exceed one square millimeter. A further electron source is described by F. Haase et al. ("Electron permeable membranes for MEMS electron sources", in: Sensors and Actuators A: Physical, Vol. 132 (2006), No. 1, pages 98-103). In this, a plane membrane of silicon nitride, only 100 nanometers thick is mounted on a supporting honeycomb of silicon. The supporting structure is between 5 and 10 micrometers thick. The diameter of each honeycomb cell is around 10 micrometers.

A proportion of the electron energy always remains in the window when an electron passes through. The main effect of the absorbed energy is to heat the window up, but secondary electrons and X-ray quanta are also generated. The electron-permeable region of the window will be referred to below as the "window membrane". The supporting frame for the window membrane ("window frame") is significantly thicker than the window membrane, and therefore exhibits greater thermal conductivity than the membrane. In thermal equilibrium there is a temperature gradient between the hotter center of the window membrane and its supporting frame. The inhomogeneous temperature distribution generates mechanical stresses in the window, which the window membrane must be able to withstand. Furthermore, the heating-up of the window has the effect that the window membrane becomes more permeable to gas, and consequently the pressure in the vacuum chamber can rise to a point where the function of the electron source is no longer assured.

SUMMARY OF THE INVENTION

According to an aspect of the invention, an APCI ion source uses a window with a structured form between a vacuum chamber with a non-radioactive electron source and a reaction chamber.

"Window membrane with a structured form" or "structured window membrane" means a window membrane that is not plane; instead it is shaped to structures in a third dimension, for instance, like the folds of corrugated iron or as dome-like bulges. The structures can, for instance, have a V-shaped, sinusoidal, trapezoidal or rectangular cross-section. The folds of a window membrane can be concentric with the center of the window, may run parallel to the edges of the window membrane, or, as in corrugated iron, may all be parallel to one another. In contrast to windows having a plane membrane of the prior art, a window having a structured membrane offers several advantages:

1. As electrons pass through, part of their energy is absorbed by the window membrane, causing a temperature gradient to develop and thereby generating lateral mechanical stresses that can damage the window membrane. In a window according to an aspect of the invention, the shaped structures of the window membrane act as spring elements that absorb these lateral mechanical stresses, thereby increasing the mechanical strength of a window membrane of the same thickness. This in turn means that a structured window membrane can be thinner than a plane window membrane for the same level of mechanical strength, and therefore heats up less when irradiated with electrons. The reduced heating in turn results in lower gas leakage through the window membrane.
2. In addition to the thermal stress, the thin window membrane must withstand the pressure difference between the vacuum chamber and the reaction chamber. A plane window membrane bows in response to the pressure forces, and expands over the entire surface, whereas the spring elements in the structured window membrane can absorb the forces. The shaped structures thus increase the stiffness of the window membrane, so that a structured window membrane can be thinner than a plane window membrane for the same pressure difference and membrane area.
3. To enable windows with thin and plane window membranes to withstand the pressure load, they can be provided with a mechanical supporting structure, on which the surface of the window membrane can lie, as, for instance, in German Patent DE 196 27 621 C2, or can be permanently bonded to the window membrane, as, for instance, the honeycomb in the electron source described by Haase et al. Only in the latter case does the supporting structure also lend the window improved thermal conductivity. Here, the supporting construction can also absorb the stresses caused by the temperature gradient. In both cases, supporting the window membrane reduces the permeability of the window for electrons because the electrons will also impact the thick supporting structure and lose a significantly greater proportion of their kinetic energy, if not all. This will also generate unwanted X-ray radiation.
4. In contrast to a plane window membrane, a structured window membrane has a larger surface area. Due to the larger contact area with the gas in the reaction chamber, and the larger emission area for thermal radiation, the structured window membrane is more efficiently cooled than a plane window membrane.

In order to ensure both adequate mechanical stability and permeability to low-energy electrons simultaneously, the thickness of the structured window membrane is preferably between 20 and 1000 nanometers, most preferably between 30 and 100 nanometers and particularly at around 50 nanometers. The thickness of the window membrane should be understood to refer to the material thickness measured normal to the surface.

A structural element in a structured window membrane is predominantly characterized by its lateral dimension (width) and its depth (see FIGS. 1A and 1B: B=width, T=depth). The width is preferably between 0.1 micrometers and 100 micrometers, particularly between 1 and 10 micrometers. The ratio between the width and depth (the "aspect ratio") is preferably between 5:1 and 1:10, particularly around 1:1. The lateral spacing between two structural elements is preferably between 0.2 micrometers and 100 micrometers, most preferably between 1 and 10 micrometers, and particularly around 2 micrometers.

The permeability to electrons decreases with the atomic number of the material of the window membrane. In addition, the conversion efficiency for the undesirable X-ray radiation rises with the atomic number. The mean atomic number of the materials used in the window membrane is preferably less than or equal to 33, and particularly smaller than or equal to 15. On the basis of the established methods from microelectronics, suitable materials for the manufacture of structured window membranes are, in particular, silicon, doped silicon, silicon nitride and silicon carbide.

The parameters characterizing the structures of a structured window membrane can vary at different locations across the surface: for example, the thickness of the window membrane, the material of the window membrane and the dimensions of the structures.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
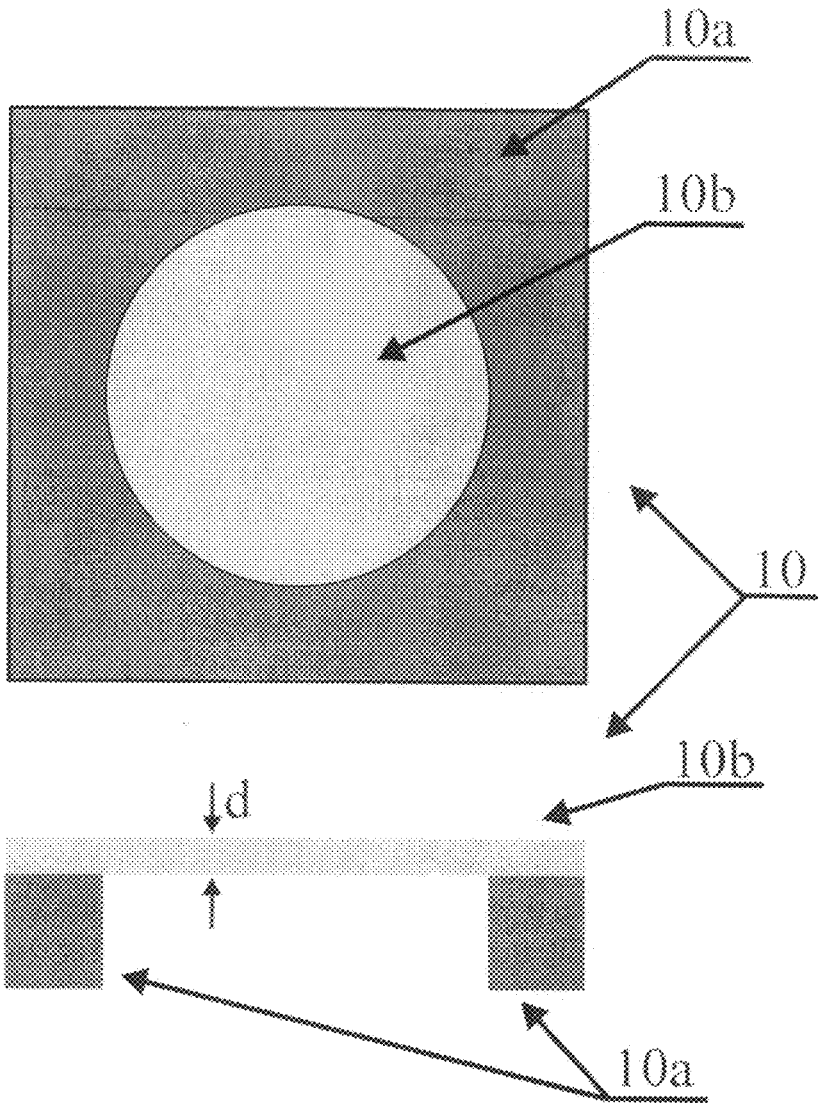
Figure 1 (prior art)
FIG. 1 shows a cross-section and a top view of a prior art window 10 with a plane, single-layer window membrane 10*b;*

FIG. 1 shows a cross-section and a top view of a prior art window 10 with a plane single-layer window membrane 10*b*. The window 10 includes a membrane carrier 10*a* of silicon and a plane window membrane 10*b* of silicon nitride. The electron-permeable region of the window 10 is circular, and has a diameter of about 0.8 millimeters. The illustration is a schematic, i.e., not to scale. The silicon nitride window membrane 10*b* has a thickness d of 300 nanometers, and can withstand a pressure of 1 atmosphere.

The range of electrons in solid material can be estimated using Weber's empirical equation (cited in: G. Hertz: "Lehrbuch der Kernphysik" ("Textbook of Nuclear Physics"), Volume 1, B. G. Teubner Verlagsgesellschaft, Leipzig, 1966, page 189ff):

$$R_{max}=0.5\cdot E\cdot(1-0.983/(1+4.29\cdot E)), \quad \text{ii.}$$

where $R_{max}$ is the maximum range in grams per square centimeter (g/cm$^2$) and E is the electron energy in megaelectronvolts (MeV). The range of electrons in the material is expressed, in this equation, as the product of the traveling distance L and the material density ρ [g/cm$^3$], referred to as the area density [g/cm$^2$]. For a given material, the distance L [cm] can be calculated.

Weber's equation is applicable to electron energies between 3 kiloelectronvolts and 3 megaelectronvolts. In Weber's empirical equation, the range $R_{max}$ corresponds to about 7 half-value thicknesses for the energy loss, i.e., after traveling the range $R_{max}$, electrons have a residual energy equal to $1/2^7$ of their initial energy (i.e., about 0.8%).

For the silicon window membrane 10*b* with 300 nanometers thickness, it follows that with an electron energy of 15 kiloelectronvolts, which corresponds to the mean electron energy of a $^{63}$Ni beta emitter (about 16 kiloelectronvolts), around 50% of the electron energy is absorbed in the window membrane 10*b*.

Figure 2:
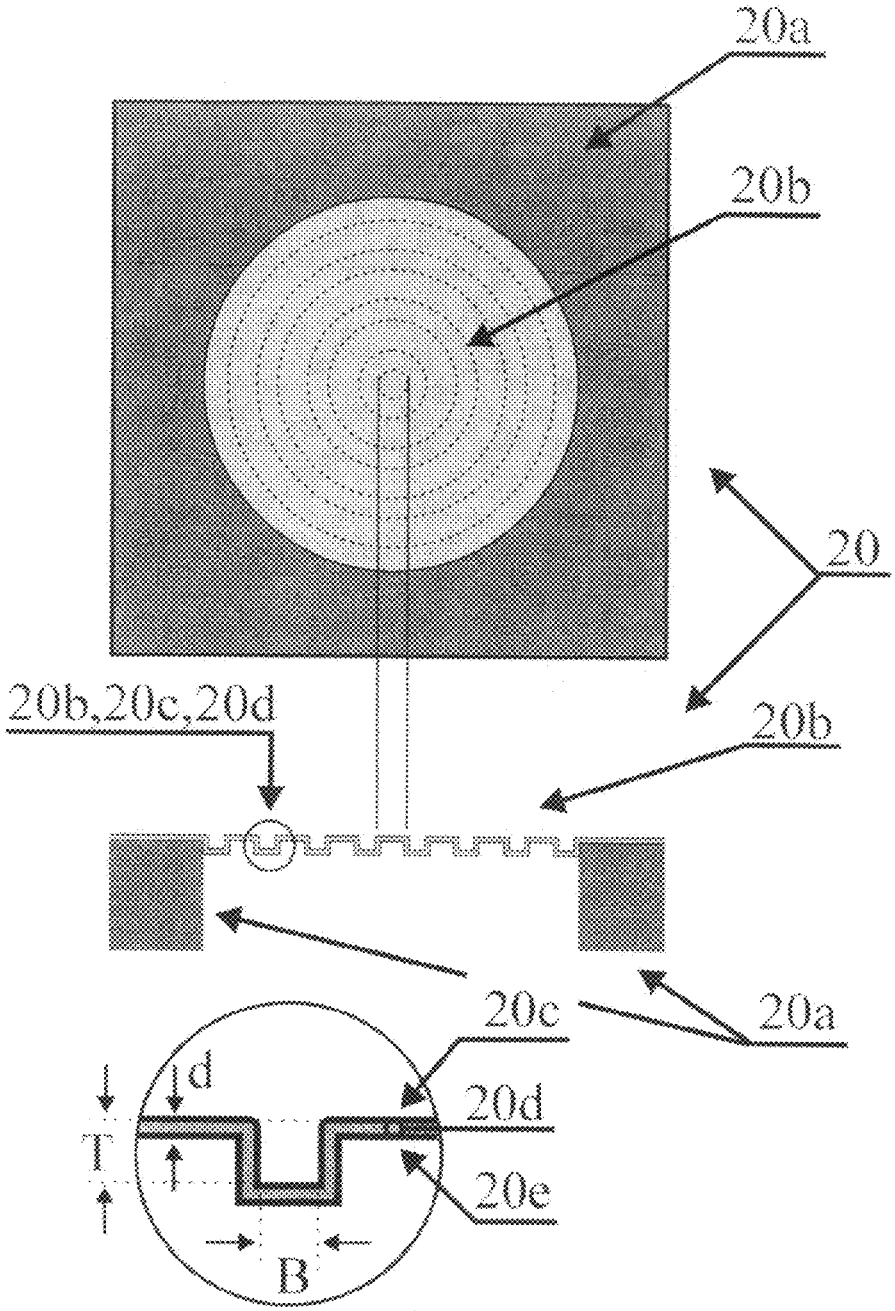
FIG. 2 shows a cross-section and a top view of a window 20 with a window membrane 20*b* which has corrugated folds and includes of three layers 20*c*, 20*d*, 20*e;*

FIG. 2 shows a cross-section and a top view of a window 20 with a structured window membrane 20*b*. The illustration is not to scale. The window 20 includes of a membrane carrier 20*a* of silicon and a window membrane 20*b*, which has corrugated folds and includes for example three layers 20*c*, 20*d*, 20*e*. The electron-permeable region is radially symmetrical and has the internal diameter of the membrane carrier 20*a*. The folds of the membrane window 20*b* are approximately 2 micrometers wide (width B) and deep (depth T), therefore having an aspect ratio of 1:1. They are about 4 micrometers apart.

The internal layer 20*d* includes silicon nitride and is only about 50 nanometers thick. The layers 20*c*, 20*e* includes titanium nitride (TiN) and are only about 10 nanometers thick. With a total thickness d of 70 nanometers, it is the layer 20*d* of silicon nitride which determines the mechanical strength of the membrane window 20*b*. The two titanium nitride layers 20*c*, 20*e* have high electrical conductivity, preventing the window 20 from becoming electrostatically charged. Membrane windows with shaped structures having more than three layers bonded together are also possible. Through the choice of materials for the layers and their thicknesses, it is possible to optimize properties such as thermal conductivity, emissivity for thermal radiation, elasticity (mechanical strength), permeability to electrons, gas permeability (leakage rate), and electrical conductivity. Within certain limits these properties can be optimized independently of one another. Patent publication WO 2004/097882 A1 (Wieser et al.) discloses plane window membranes of several layers, where the emissivity for electromagnetic thermal radiation is maximized to minimize heating of the window membranes. In the patent specifications from Budovich et al. mentioned above, the mica disk used has a vapor-deposited aluminum coating.

Weber's equation indicates that only about 20% of the electron energy is absorbed in the membrane window 20*b* if the electrons have an initial energy of 15 kiloelectronvolts. When subjected to the same pressure load and electron radiation, the structured window 20 heats up less than the plane window 10. In addition, the structured window 20 exhibits lower gas permeability, even though window membrane 20*b* is thinner than window membrane 10*b*.

Figure 3:
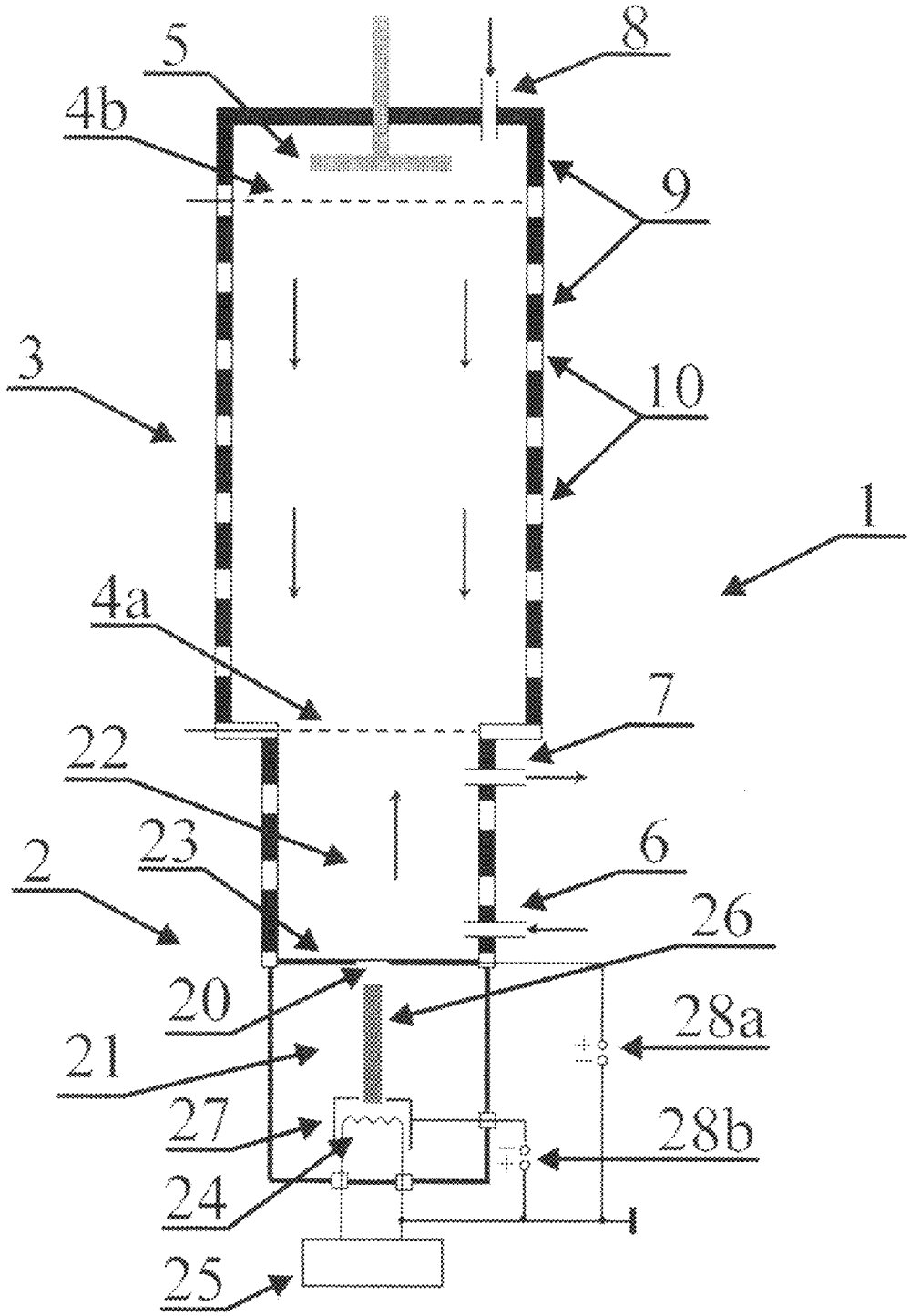
FIG. 3 shows the measuring cell of a time-of-drift type IMS 1 with an APCI ion source 2, in which the window 20 separates the vacuum chamber 21 from the reaction chamber 22 of the measuring cell 1.

FIG. 3 illustrates schematically the measuring cell 1 of a time-of-drift type IMS with an APCI ion source 2.

The measuring cell 1 of the IMS includes the APCI ion source 2 and a drift chamber 3, separated from one another by a switchable grid 4*a*. The switchable grid 4*a* is connected to a source of voltage pulses, not shown. The APCI ion source 2 includes a vacuum chamber 21 and a reaction chamber 22, separated from another by a partition 23 with embedded window 20, as shown in FIG. 1B. The partition 23 is impermeable to both gas and low-energy electrons, whereas the window 20 is permeable to low-energy electrons but essentially impermeable to gas.

The pressure in the vacuum chamber 21 should be less than about 1/100 Pascal. The reaction chamber 22 is at atmospheric pressure. IMS devices do not generally incorporate vacuum chambers, unless they incorporate integrated pumping systems with which a vacuum chamber can be evacuated. Even passive pumping systems, not using any energy, for example sorption pumps, are critical. For IMS devices that operate with air as the carrier gas, sorption pumps in particular are only of very limited value because, on the one hand, helium, as a trace gas, passes very easily through thin window membranes while, on the other hand, a sorption pump does not have either adequate pumping capacity or an ability to bind helium. In order to maintain the function of an electron source in a vacuum for a commercially relevant duration, the leakage rate of the window 20 should be less than about $10^{-10}$ Pascal liters per second. Thickness, surface area, material and, in particular, the temperature of the window membranes determine the leakage rate. As the temperature of a structured window membrane is lower than that of plane window membranes, APCI ion sources according to the invention are able to operate significantly longer without an integrated vacuum system.

The housing of the reaction chamber 2 and the housing of the drift chamber 3 each include metal rings 9 separated by rings 10 of an insulating material such as ceramic. The metal rings 9 are connected to a high-voltage DC source via a voltage divider in such a way that an electrical drift field acting in the direction of a collecting electrode 5 is created in both chambers 22 and 3. A screen grid 4*b* is located directly in front of the collecting electrode 5, decoupling the collecting electrode 5 electrostatically from the drift chamber 3. To avoid complicating the diagram, the voltage divider, the high-voltage DC source and the electrical circuit are not illustrated.

The reaction chamber 22 incorporates a gas supply line 6 and a gas exit line 7 serving respectively to introduce and exhaust the carrier gas containing the analytes. At the end of the drift chamber 3 there is a gas supply line 8 for filtered drift gas that does not contain any analyte molecules. A gas flow in the direction of the reaction chamber 22 is created within the drift chamber 3, thereby preventing the carrier gas with the analytes from entering the drift chamber 3. The drift gas also leaves the measuring cell 1 of the IMS through the gas exit line 7.

The vacuum chamber 21 contains a thermal emitter 24 in the form of a tungsten filament 24 connected to a filament voltage source 25. The electrons in the vacuum chamber 21 can, however, also be generated in other ways, for instance using a field emission emitter (cold emitter) or a photo-emitter. It is also possible for the vacuum chamber 21 to contain a multitude of electron emitters, in which case a separate membrane window with shaped structures can be incorporated for each individual electron emitter.

The thermal emitter 24 is connected to the negative pole of an accelerating voltage source 28*a*, while the conductive partition 23 and the conductive titanium nitride layers 20*c*, 20*e* of the window 20 are connected to the positive pole of the accelerating voltage source 28*a*. The accelerating voltage 28*a* is preferably between 2 kV and 200 kV, most preferably between 5 kV and 50 kV, and particularly around 15 kV. The control electrode 27 is at a small negative potential, such as minus 10 V, provided by the voltage source 28*b*. The position of the control electrode 27 between the thermal emitter 24 and the partition 23, its dimensions and its potential 28*b* are designed so that the primary electrons are guided to the window 20.

The measuring cell 1 of the IMS operates as follows. The tungsten filament of the thermal emitter 24 is heated by a current from a filament voltage source 25, and emits primary electrons 26. After passing through the accelerating voltage between the thermal emitter 24 and the partition 23, the primary electrons 26 have a kinetic energy of around 15 kiloelectronvolts. The control electrode 27 operates as electron lens and focuses the primary electrons 26 onto the window 20.

Having passed into the reaction chamber 22, the electrons interact with the molecules of the carrier gas, and also with the analyte molecules. The range of the most energetic electrons in air at standard pressure is approximately 4 mm, with the mean range being around 1 mm. The region in which the APCI ion source 2 can generate reactant ions is therefore very restricted. Ionization of the analyte molecules in the reaction chamber 22 takes place predominantly through reactions with the reactant ions. The analyte molecules are thus ionized in the reaction chamber 22 itself. On the other hand, it is also possible for reactant ions to be generated in a first reaction chamber and then to be transferred to a second, spatially separate, reaction chamber, where the analyte molecules are then ionized by secondary reactions, as described in, for example, the patent specification DE 196 37 205 C2 by H. Hertle et al: "Massenspektroskopie-Verfahren" ("Mass Spectroscopy Methods").

The voltages applied to the metal rings 9 create an electrical field, which moves the ions generated in the reaction chamber 22 (which may be positive or negative, depending on the polarity of the high-voltage DC source) toward the switchable grid 4*a*. Short, periodic voltage pulses (0.1 to 5 ms) are supplied to the switchable grid 4*a* by a pulsed voltage source (not illustrated). These voltage pulses open the switchable grid 4*a*, permitting an ion packet to enter the drift chamber 3. In the electrical field of the drift chamber 3, the ions move toward the screen electrode 4*a* and the collecting electrode 5. During the drift period, the ions become temporally separated due to their different ion mobilities. When they impinge on the collecting electrode 5, the ions generate an electrical current that is amplified by an electrical circuit and measured. The measured function of the ion current against the drift time is referred to as the ion mobility spectrum, and is specific to each analyte.

Figure 4A:
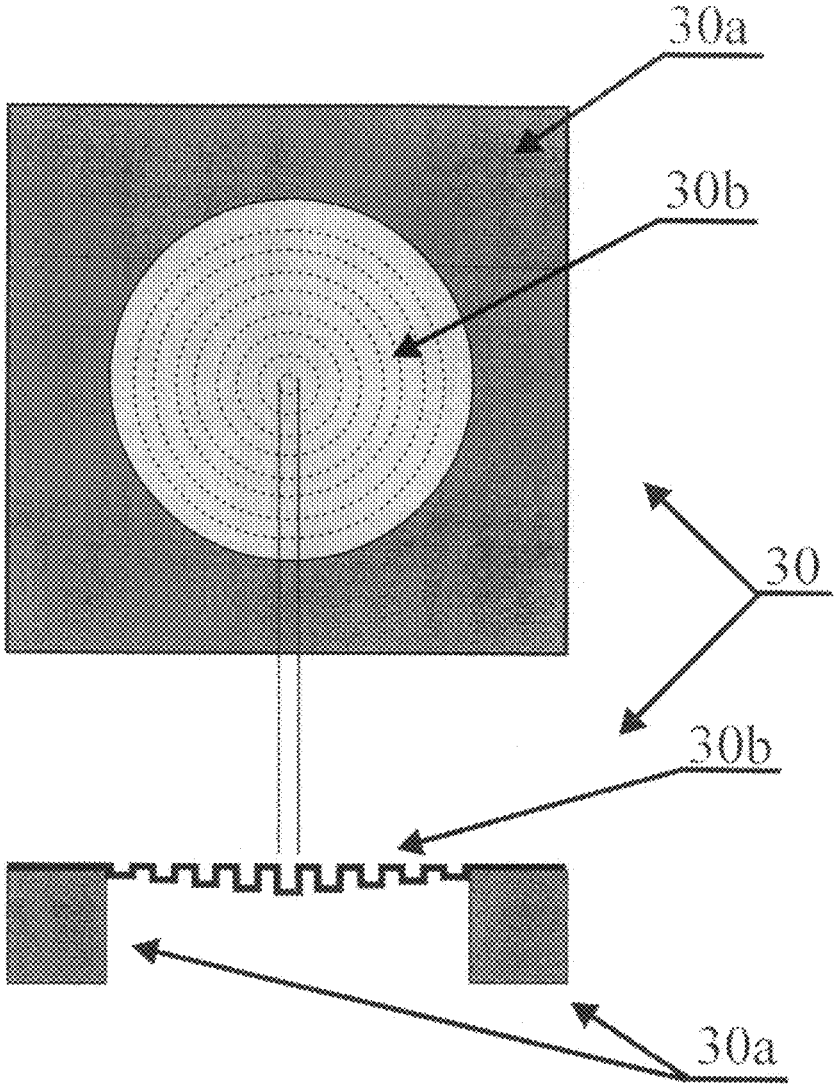
FIGS. 4A and 4B show two further preferred embodiments of windows 30 and 40 having structured window membranes 30*b*, 40*b*.
Figure 4B:
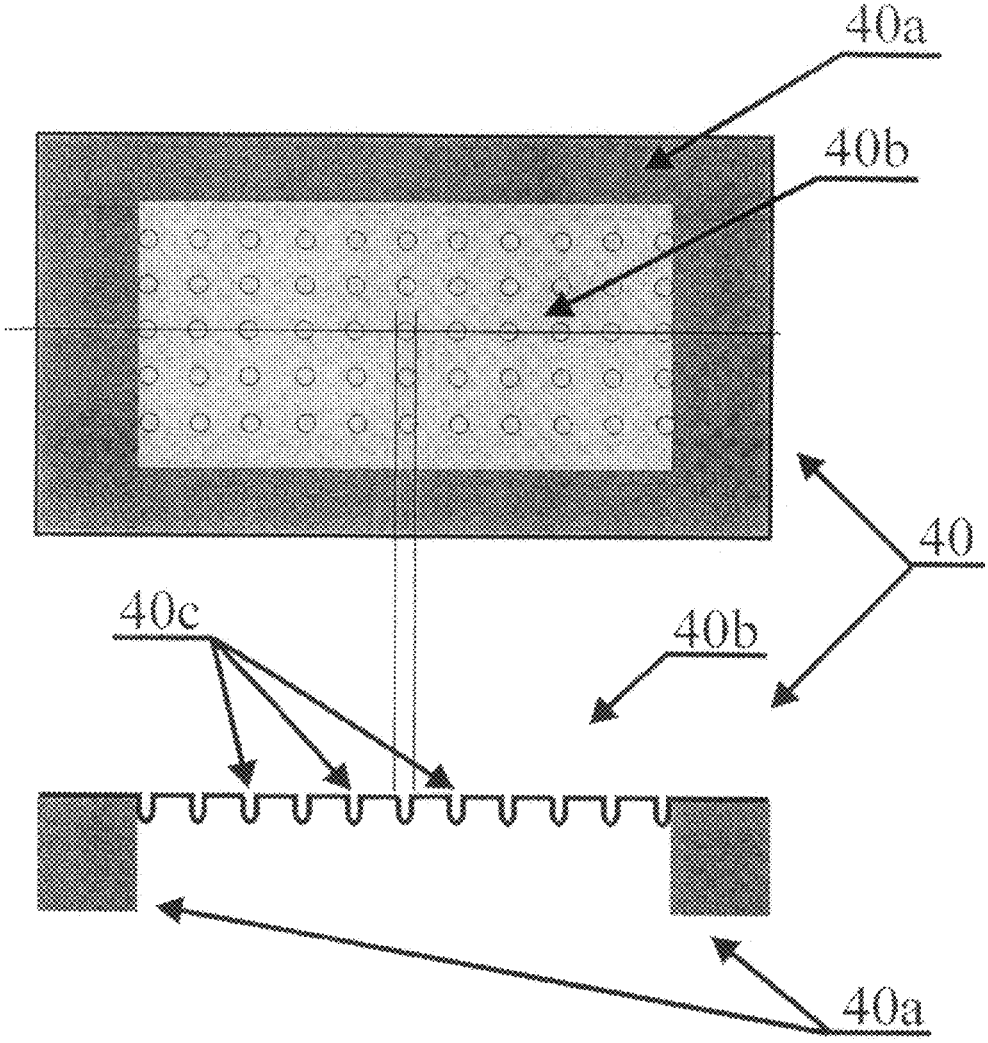

FIGS. 4A and 4B show two further preferable windows 30, 40 for an APCI ion source. The windows 30, 40 each includes a membrane holder 30*a*, 40*a* made of silicon and a window membrane 30*b*, 30*c* with structured shapes. The windows 30, 40 are again only shown schematically. In other words, the geometric dimensions of the shaped structures, such as the lateral distance between the structures, the width and depth of the structures, and the thickness of the window membranes, are not true to scale.

FIG. 4A shows a cross-section and a top view of a window 30. The window 30 includes a membrane carrier 30*a* of silicon and a window membrane 30*b*, 50 nanometers thick and made of silicon carbide. The electron-permeable region of the window 30 is circular and has a diameter of 1 millimeter.

The window membrane 30*b* has corrugated folds and a radial symmetry. The folds are about 1 micrometer wide and spaced about 2 micrometers apart. The geometric dimensions of the shaped structural elements can, however, differ at different parts of the window membrane. For example, the depth of the folds here is about 2 micrometers in the center and decreases to about 0.5 micrometer toward the edge. In comparison with silicon nitride, silicon carbide has a lower specific electrical resistance (SiC: $10^2$ to $10^6$ Ohm-centimeters, $Si_3N_4$: $10^9$ to $10^{15}$ Ohm-centimeters), as a result of which an electrostatic charge on the window 30 can be avoided without the need for additional layers. In addition, silicon carbide has a thermal conductivity some five times greater than that of silicon nitride (SiC: 30 to 250 Watts per meter-Kelvin, $Si_3N_4$: 7 to 70 Watts per meter-Kelvin). Generally speaking, the material used for a window membrane with a structured form should have a high thermal conductivity, preferably more than 10 Watts per meter-Kelvin (W/(m·K)), and particularly greater than 100 Watts per meter-Kelvin.

FIG. 4B shows a cross-section and a top view of a window 40 with dome-like structural elements. The electron-permeable region is rectangular in shape and has an area of 2 square millimeters (1 mm×2 mm). The shape window frame is chosen to match a particular task, for example to transmit a rectangular electron beam, and can, for instance, also take the form of a honeycomb. A window according to an aspect of the invention typically has an electron-permeable region measuring between 0.01 and 10 square millimeters; the structured window membrane may be given additional mechanical support, but as a rule this is not necessary. The structured window membrane 40*b* includes silicon nitride and is about 100 nanometers thick.

In contrast to the windows 20 and 30, the structured window membrane 40 is not folded, but has a large number of round, dome-shaped bulges 40*c*. The bases of the bulges can, however, be plane or conical. The bulges 40*c* have a width of approximately 1 micrometer and a depth of about 2 micrometers. The distance between neighboring bulges 40*c* is 4 micrometers.

In general, the materials of the window and the type, size, shape and spacing of the structural elements used for the ion source are chosen, depending on the particular application, on the basis of the electron-permeability, gas-impermeability, mechanical strength, and reliability and cost of manufacture. For the manufacturing process, a variety of methods known in the technical area of chip production can be used, for example, but not restricted to, pure silicon, doped silicon, and silicon containing materials like silicon alloys and silicon compounds.

The quantitative data given in connection with the individual example embodiments, particularly regarding materials, the general structure and the preferred dimensions are not restricted to these embodiments, but can be applied analogously to other cases that the specialist will recognize. The invention is not limited to the embodiments described. Persons skilled in the art will be able to develop modifications and combinations.

Although the present invention has been illustrated and described with respect to several preferred embodiments thereof, various changes, omissions and additions to the form and detail thereof, may be made therein, without departing from the spirit and scope of the invention.

What is claimed is:

1. An atmospheric pressure chemical ionization (APCI) ion source, comprising:

a vacuum chamber having an electron source;

a reaction chamber under atmospheric pressure coupled to the vacuum chamber; and a window having a window membrane that is permeable to electrons and essentially impermeable to gas and that is three-dimensionally structured at a thickness less than 100 nanometers, the window separating the vacuum chamber and the reaction chamber.

2. The ion source of claim 1, wherein the structured window membrane further comprises a plurality of structural elements in a lateral plane of the window.

3. The ion source of claim 2, wherein the structural elements has a size between 0.1 and 100 micrometers.

4. The ion source of claim 2, wherein the ratio of the lateral size of the structural element to its depth is between 5:1 and 1:10.

5. The ion source of claim 2, wherein the spacing between neighboring structural elements is between 0.2 and 100 micrometers.

6. The ion source of claim 2, wherein at least one of the thickness of the structured window membrane, the material of the structured window membrane, and the shape and the dimensions of the structured elements of the structured window membrane change in at least one lateral dimension.

7. The ion source of claim 1, wherein the structured window membrane comprises a material having a thermal conductivity greater than 10 Watts per meter-Kelvin (W/(m·K)).

8. The ion source of claim 1, wherein the structured window membrane has an electrical conductivity that prevents the development of electrostatic charge on the window membrane.

9. The ion source of claim 1, wherein the mean atomic number of the materials used in the structured window membrane is at least one of equal to and less than 33, the materials comprising at least one of silicon, silicon nitride, silicon carbide, boron nitride, carbon in at least one of an amorphous and crystalline phase, and titanium nitride.

10. The ion source of claim 1, wherein the structured window membrane comprises a plurality of layers bonded together.

11. The ion source of claim 1, wherein the structured window membrane further comprises a plurality of folds.

12. The ion source of claim 1, wherein the structured window membrane further comprises a plurality of bulges, each bulge having one of a dome and truncated cone shape.

13. The ion source of claim 1, wherein the structured window membrane has a radial symmetry.

14. The ion source of claim 1, wherein the vacuum chamber further comprises an electrical acceleration region with an accelerating voltage of between 2 and 200 kV.

15. The ion source of claim 14, wherein the electron source is connected to a negative pole and the window is connected to a positive pole of the electrical accelerating region.

16. The ion source of claim 1, wherein the electron source comprises at least one of a thermionic cathode, a field emitter cathode and a photocathode.

17. A method for atmospheric pressure chemical ionization (APCI), comprising:

generating electrons from an electron source in a vacuum chamber;

permeating the electrons through a window having a window membrane that is essentially impermeable to gas and that is three-dimensionally structured at a thickness of less than 100 nanometers, the window separating the vacuum chamber and a reaction chamber under atmospheric pressure;

filling the reaction chamber with a carrier gas having analyte molecules; and ionizing the analyte molecules with the electrons.

18. The method of claim 17, further comprising accelerating the electrons in the vacuum chamber.

19. The method of claim 17, wherein the structured window membrane comprises a plurality of structural elements in a lateral plane of the window.

20. The method of claim 17, further comprising measuring an electrical current generated by the ionized analyte molecules impinging on an electrode.

21. The method of claim 17, further comprising generating an electric field to move the ionized analyte molecules through the reaction chamber.

22. The method of claim 21, further comprising permitting the ionized analyte molecules to pass from the reaction chamber, through a switchable grid and into a drift chamber.

* * * * *